US011668027B2

(12) United States Patent
Zhou et al.

(10) Patent No.: US 11,668,027 B2
(45) Date of Patent: Jun. 6, 2023

(54) WEAVING METHOD OF WEFT-BACKED JACQUARD FABRIC WITH COLOR SHADING EFFECT

(71) Applicant: Zhejiang Sci-Tech University, Zhejiang (CN)

(72) Inventors: Jiu Zhou, Zhejiang (CN); Xi Peng, Zhejiang (CN)

(73) Assignee: Zhejiang Sci-Tech University, Hangzhou (CN)

( * ) Notice: Subject to any disclaimer, the term of this patent is extended or adjusted under 35 U.S.C. 154(b) by 16 days.

(21) Appl. No.: 17/538,619

(22) Filed: Nov. 30, 2021

(65) Prior Publication Data

US 2022/0170185 A1 Jun. 2, 2022

(30) Foreign Application Priority Data

Nov. 30, 2020 (CN) ..... 202011370196.5

(51) Int. Cl.
*D03D 13/00* (2006.01)
*D03D 15/54* (2021.01)
*D03C 19/00* (2006.01)

(52) U.S. Cl.
CPC ..... *D03D 13/004* (2013.01); *D03D 15/54* (2021.01)

(58) Field of Classification Search
CPC ..... D03D 13/004; D03D 15/54; D03D 13/00; D10B 2403/0114
See application file for complete search history.

(56) References Cited

U.S. PATENT DOCUMENTS 3,671,944 A * 6/1972 Dubner ..... D03C 19/005 139/319
4,078,253 A * 3/1978 Kajiura ..... D03C 19/005 700/131
4,417,605 A * 11/1983 Miyashita ..... D03D 23/00 139/55.1
5,058,174 A * 10/1991 Carroll ..... D03C 19/005 348/93
5,829,487 A * 11/1998 Thomas ..... D03C 19/005 139/319
6,865,439 B1 * 3/2005 Tu ..... D04B 37/02 700/131
8,050,791 B2 * 11/2011 Li ..... D03C 19/00 700/133

* cited by examiner

*Primary Examiner* — Robert H Muromoto, Jr.
(74) *Attorney, Agent, or Firm* — Harness, Dickey & Pierce, P.L.C.

(57) ABSTRACT

The present disclosure provides a weaving method of a weft-backed jacquard fabric with color shading effects and belongs to the technical field of weaving methods. In a single-warp and double-weft structure with a weft yarn arrangement ratio of Wefts A and Wefts B of 2:1, by designing two groups of face weaves and backing weaves and corresponding backed points and using a shaded strengthening method, two color shading effects of color shading of the Wefts A and mixed color shading of the Wefts A and the Wefts B of the fabric are achieved. A maximum number of shaded weaves is $[R/N(6R-2J_2-J_1-3)+2]$, and a grade number of shaded color is less than or equal to the maximum number of the shaded weaves. The designed fabric meets the covering requirements and can be mass produced.

8 Claims, 6 Drawing Sheets

WEAVING METHOD OF WEFT-BACKED JACQUARD FABRIC WITH COLOR SHADING EFFECT

CROSS REFERENCE TO RELATED APPLICATION

This patent application claims the benefit and priority of Chinese Patent Application No. 202011370196.5, filed on Nov. 30, 2020, the disclosure of which is incorporated by reference herein in its entirety as part of the present application.

TECHNICAL FIELD

The present disclosure relates to a weaving method of a weft-backed jacquard fabric with color shading effects, and belongs to the technical field of weaving methods.

BACKGROUND ART

A traditional jacquard fabric with 2:1 weft-backed structure uses a single plane design mode. Due to the limitation of the weave structure and weaving technology, the color of the fabric is mainly to express the inherent color of the weft yarn, and is less in number and a lacks sense of layering. In order to increase the number of fabric colors, the Wahua technique is generally used. On the one hand, this method increases the thickness of the fabric and the yarns on the back of the fabric are messy, which limits the application of the fabric. On the other hand, this method can only be used by hand, so that the production efficiency is extremely low, and mass production cannot be achieved. A jacquard fabric with 2:1 weft-backed structure, which is rich in color, light and thin and can be mass produced, cannot be designed by traditional design methods. So far, no literature has proposed a weaving method of a weft-backed jacquard fabric by using 2:1 weft-backed structure to achieve color shading effect of Wefts A and mixed color shading effects of Wefts A and Wefts B on the surface of the fabric.

SUMMARY

In order to solve the problem that a traditional jacquard fabric with 2:1 weft-backed structure has few colors, is low in efficiency and cannot be mass produced, the present disclosure provides a weaving method of a weft-backed jacquard fabric with color shading effects. In a single-warp and double-weft structure with a weft yarn arrangement ratio of Wefts A and Wefts B of 2:1, by designing two groups of face weaves and backing weaves and corresponding backed points and using a shaded strengthening method, the Weft A and the Weft B can both be the face weft to cover the backing weft, and the color shading effect of the Wefts A and mixed color shading effects of Wefts A and Wefts B on a surface of the fabric are achieved. A maximum number of shaded weaves is $[R/N(6R-2J_2-J_1-3)+2]$, and a grade number of shaded color is less than or equal to the maximum number of the shaded weaves. R is a number of weft repeats of the Weft B, N is an added value of weave points, and $J_1$ and $J_2$ are respectively numbers of backed points on one weft yarn in one weave repeat when the Weft B and the Weft A are used as the face weft. Compound structures of the designed fabric meet balanced interlacement and can be mass produced.

An implementation method and main technical content of the present disclosure are as follows.

(1) Construction of a structural model

1) The fabric is woven by 1 set of warp yarns and 2 sets of weft yarns. The warp yarns are in one color. The weft yarns are in two colors for a Weft A and a Weft B. The Weft A and the Weft B have an arrangement ratio of 2:1. The Weft A and the warp yarns are interwoven to form a Weft A weave. The Weft B and the warp yarns are interwoven to form a Weft B weave.

2) When a face weft is the Weft A, the Weft A weave is a face weave and the Weft B weave is a backing weave. When the face weft is the Weft B, the Weft B weave is a face weave and the Weft A weave is a backing weave.

(2) Selection of the Weft A weave and Weft B weave

Different weaves as required are selected according to design requirements of different fabrics.

1) The required Weft B weave is selected. The Weft B weave is selected in a range of derivative weaves of warp-separated plain, twill and satin. A number of weave repeats is 2R×R in a range between 4×2 and 48×24 ($2 \le R \le 24$ and R is a positive integer).

2) The corresponding Weft A weave is selected according to the characteristics of the selected Weft B weave. The Weft A weave is selected in a range of twill or satin. A number of warp repeats is the same as that of the Weft B weave, a number of weft repeats is twice that of the Weft B weave, and a number of weave repeats is 2R×2R in a range between 4×4 and 48×48 ($2 \le R \le 24$ and R is a positive integer).

(3) Design of the face weave and backing weave and backed points when the face weft is the Weft B 1) Design of the backing weave A warp-faced weave is selected as a backing weave $A_L$ in the selection range of the Weft A weave. A number of weave repeats is 2R×2R ($2 \le R \le 24$ and R is a positive integer).

2) Design of backed points Bj

Backed points (similar to a kind of weave) are designed for a face weave $B_B$ according to weave characteristics of the backing weave $A_L$ in the following method: reversing the backing weave $A_L$ to obtain a reverse weave $A_LF$, then decomposing the $A_LF$ into decomposed weaves $A_LF1$ and $A_LF2$ according to odd and even wefts, and finally superimposing warp weave points of the $A_LF2$ on the $A_LF1$ to obtain the backed points Bj.

3) Design of the face weaves

The face weave $B_B$ is a weft-faced weave. A number of weave repeats is the same as that of the Bj. Positions of all weft weave points in the Bj are positions of all possible warp weave points in the $B_B$. One weave point is selected for each weft from all weft weave points of the Bj as warp weave points to form the face weave $B_B$ on the premise of meeting balanced interlacement.

Further, as a preferable solution:

a step number of the face weave $B_B$ is selected the same as that of the $A_LF1$ or $A_LF2$. Starting from a starting point position at a lower left corner (warp, weft)=(1, 1), a weft-faced weave is designed according to the selected step number in a weave grid with a number of weave repeats of 2R×R. Then, each time when the starting point is moved one weave point in a weft direction, one new weave is designed, and a series of weaves are designed until the starting point position is (2R, 1). The weaves having warp weave points overlapping with that of the Bj are eliminated from this series of weaves to obtain all alternative weaves of the face weave $B_B$ that meet requirements. There are $(2R-J_1)$ such alternative weaves in total. One weave is selected from the alternative weaves as the face weave $B_B$ according to the requirements.

(4) Design of the face weave and backing weave and backed points when the face weft is the Weft A 1) Design of the backing weave A warp-faced weave is selected as a backing weave $B_L$ in the selection range of the Weft B weave. A number of weave repeats is 2R×R (2≤R≤24 and R is a positive integer). Further, to improve the efficiency, a reverse weave $B_BF$ of the above face weave $B_B$ may be used as the backing weave $B_L$.

2) Design of the face weaves

Decomposed weaves $A_B1$ and $A_B2$ of the face weave are the weft-faced weaves. A number of weave repeats is the same as that of the backing weave $B_L$. Positions of all warp weave points in the backing weave $B_L$ are positions of all possible warp weave points in the $A_B1$ and $A_B2$. One warp weave point is selected for each weft from all warp weave points of the $B_L$ to form the weave $A_B1$ or $A_B2$ on the premise of meeting balanced interlacement.

Further, as a preferable solution:

the backing weave $B_L$ is reversed to obtain a reverse weave $B_LF$. A step number of the $A_B1$ and $A_B2$ is selected the same as that of the $B_LF$. Starting from a starting point position at a lower left corner (warp, weft)=(1, 1), a weft-faced weave is designed according to the selected step number in a weave grid with a number of weave repeats of 2R×R. Then, each time when the starting point is moved one weave point in a weft direction, one new weave is designed, and a series of weaves are designed until the starting point position is (2R, 1). The weaves having warp weave points overlapping with that of the $B_LF$ are eliminated from this series of weaves to obtain all alternative decomposed weaves of the face weave $A_B$ that meet requirements. There are $(2R-J_2)$ such alternative decomposed weaves in total. According to the requirements, one weave with the starting point positions at odd warps and one weave with the starting point positions at even warps are selected from the alternative decomposed weaves and taken as the $A_B1$ and $A_B2$ respectively, and the $A_B1$ and $A_B2$ are arranged and combined in 1:1 in a warp direction to obtain the face weave $A_B$ covering the backing weave $B_L$. There are $[2(R-J_2J)(R-J_2O)]$ such weaves in total. $J_2J$ and $J_2O$ are respectively numbers of backed points at odd and even warps on one weft yarn in one weave repeat when the Weft A is used as the face weft.

3) Design of backed points Aj

Backed points (similar to a kind of weave) are designed for the face weave $A_B$ according to weave characteristics of the backing weave $B_L$ in the following method: extending each weft of the $B_LF$ one weft upwards in the warp direction or arranging and combining two $B_LF$ in 1:1 in the warp direction to obtain the backed points Aj.

(5) When there are no other special requirements, in order to improve the design efficiency, for the face weave $B_B$ and the backing weave $A_L$ when the Weft B is selected as the face weft, when the Weft A is designed as the face weft, the face weave $B_B$ and the backing weave $A_L$ are reversed as the backing weave $B_L$ and the face weave $A_B$. On the contrary, for the face weave $A_B$ and the backing weave $B_L$ when the Weft A is selected as the face weft, when the Weft B is designed as the face weft, the face weave $A_B$ and the backing weave $B_L$ are reversed as the backing weave $A_L$ and the face weave $B_B$.

(6) Design of a shaded weave-database

1) Design of a shaded weave-database of the face weave $B_B$

The shaded weave-database of the face weave $B_B$ is designed without destroying the backed points Bj. The face weave $B_B$ is moved N points at a time in the warp direction, weft direction or oblique direction according to the requirements, and skips when encountering the backed points Bj to obtain the shaded weave-database of the $B_B$.

When N=R, the number of the shaded weaves is minimum, which is $(2R-J_1)$.

When N=1, the number of the shaded weaves is maximum, which is $[R(2R-1-J_1)+1]$.

2) Design of a shaded weave-database of the face weave $A_B$

The shaded weave-database of the face weave $A_B$ is designed without destroying the backed points Aj. The face weave $A_B$ is moved N points at a time in the warp direction, weft direction or oblique direction according to the requirements, and skips when encountering the backed points Aj to obtain the shaded weave-database of the $A_B$.

When N=2R, the number of the shaded weaves is minimum, which is $(2R-J_2)$.

When N=1, the number of the shaded weaves is maximum, which is $[2R(2R-1-J_2)+1]$.

R is a number of weft repeats of the Weft B, N is an added value of weave points, and $J_1$ and $J_2$ are respectively numbers of backed points on one weft yarn in one weave repeat when the Weft B and the Weft A are used as the face weft.

(7) Design of a compound structure

1) Design of a compound structure with the Weft B covering the Weft A

The Weft A and the Weft B have the arrangement ratio of 2:1, the backing weave $A_L$ is drawn at interweaving positions of the Weft A and the warp yarns, and the face weave $B_B$ is drawn at interweaving positions of the Weft B and the warp yarns to obtain a compound structure diagram with the Weft B covering the Weft A. According to this method, each weave in the shaded weave-database of the face weave $B_B$ is combined with the backing weave $A_L$ to obtain a database of the compound structure with the Weft B covering the Weft A of the weft-backed jacquard fabric with the color shading effect.

2) Design of a compound structure with the Weft A covering the Weft B

The Weft A and the Weft B have the arrangement ratio of 2:1, the face weave $A_B$ is drawn at the interweaving positions of the Weft A and the warp yarns, and the backing weave $B_L$ is drawn at the interweaving positions of the Weft B and the warp yarns to obtain a compound structure diagram with the Weft A covering the Weft B. According to this method, each weave in the shaded weave-database of the face weave $A_B$ is combined with the backing weave $B_L$ to obtain a database of the compound structure with the Weft A covering the Weft B of the weft-backed jacquard fabric with the color shading effect.

(8) Verification method

To verify the effectiveness of the database of the compound structure of the 2:1 weft-backed jacquard fabric with the color shading effect is to verify the effectiveness of the backed points.

1) Verification method of the database of the compound structure with the Weft B covering the Weft A The most weft-faced and warp-faced weaves in the shaded weave-database of the face weave $B_B$ are combined with the backing weave $A_L$ respectively. If both compound structures are capable of meeting requirements that any one weft of the backing weave is capable of being covered by the adjacent face weaves, it indicates that combination of any one weave in the shaded weave-database with the backing weave by the above implementation method is capable of meeting technical requirements of covering, and the mixed color shading effect of the Weft B and the Weft A can be achieved on the surface of the fabric and is not limited by the subject matter.

2) Verification method of the database of the compound structure with the Weft A covering the Weft B The most weft-faced and warp-faced weaves in the shaded weave-database of the face weave $A_B$ are combined with the backing weave $B_L$ respectively. If both compound structures are capable of meeting requirements that when the face weave expresses a color on the surface of the fabric, the backing weave has no effect on the color expression of the face weave, it indicates that combination of any one weave in the shaded weave-database with the backing weave by the above implementation method is capable of meeting technical requirements of full covering, and the color shading effect can be achieved on the surface of the fabric by the face weave and is not limited by the subject matter.

(9) Design of a digital pattern

The digital pattern required for design has two color shading effects. A maximum number of colors is $[R/N(6R-2J_2-J_1-3)+2]$, and the subject matter is not limited. A bitmap mode is used. The pattern is in two colors. Each color is designed with shaded color, and a grade number of the shaded color is less than or equal to a maximum number of shaded weaves.

(10) Design of a compound structure of the fabric

A shaded color in the two shaded colors of the above designed digital pattern needing to reflect a pure color shading effect of the fabric is matched with the database of the compound structure with the Weft A covering the Weft B. The shaded color needing to reflect a mixed color shading effect is matched with the database of the compound structure with the Weft B covering the Weft A. Processing is performed by a computer, and then the shaded color of each grade is replaced with the weaves in the corresponding weave-database by a one-to-one correspondence method to form a compound structure diagram of the weft-backed jacquard fabric with the color shading effect with the arrangement ratio of the Weft A and the Weft B of 2:1.

(11) Weaving

Weft picking information is set as Weft A:Weft B=2:1 on the obtained compound structure diagram of the fabric. A suitable warp and weft density is set. One group of warp threads and two groups of colored weft threads are selected, and then the warp threads and the weft threads can be directly used to design and produce the weft-backed jacquard fabric with the color shading effect with the arrangement ratio of the Weft A and the Weft B of 2:1.

By using the weaving method provided by the present disclosure, the 2:1 weft-backed jacquard fabric with two color shading effects of color shading of the Wefts A and mixed color shading of the Wefts A and the Wefts B, meets the covering requirements, can be created, and can meet balanced interlacement and the technical requirements of mass production. The maximum number of shaded colors may be calculated as $[R/N(6R-2J_2-J_1-3)+2]$. The maximum capacity of color expression is positively correlated with a minimum number of weft repeats of the Weft B, and is inversely correlated with the added value of weave points and the numbers of backed points on one weft yarn in one weave repeat.

Under the constraints of the technical solution of the present disclosure, the two color shading effects of the fabric can be interspersed arbitrarily and are difficult to copy. When the face weft is the Weft B, one weft yarn of the Weft B needs to cover the two weft yarns of the Weft A. When the Weft A and the Weft B are selected to have the same weft yarn fineness, the Weft B cannot fully cover the Weft A, and complex random covering may occur, so the fabric shows a color mixing effect different from the original digital pattern, and it is difficult to analyze the color and weave structure design method of the original digital pattern through the physical analysis of the fabric, which technically eliminates copying and piracy.

DETAILED DESCRIPTION OF THE EMBODIMENTS

Taking designing a weft-backed jacquard fabric with color shading effects with an arrangement ratio of the Weft A and the Weft B of 2:1 by the Weft B weave with a number of weave repeats of 16×8 as an example, the implementation method of the present disclosure is described in detail.

Figure 1:
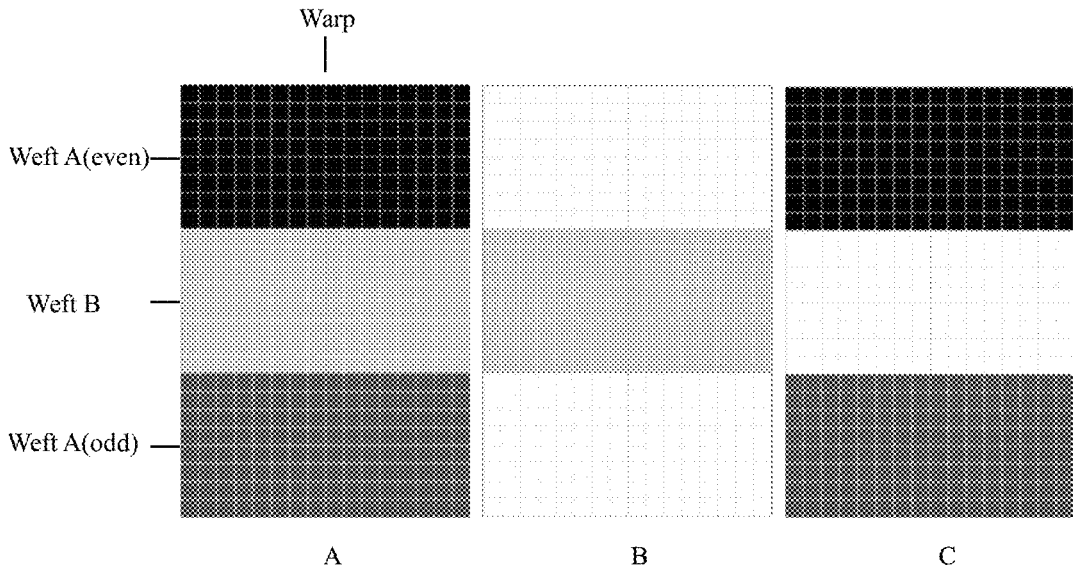
FIG. 1 is a schematic diagram of a structural model of a weft-backed jacquard fabric with color shading effects with an arrangement ratio of a Weft A and a Weft B of 2:1.

1. In FIG. 1, the fabric is woven by 1 set of warp yarns and 2 sets of weft yarns. The warp yarns are in one color. The weft yarns are in two colors for a Weft A and a Weft B. The Weft A and the Weft B have an arrangement ratio of 2:1 (A in FIG. 1). The Weft A and the warp yarns are interwoven to form a Weft A weave. The Weft B and the warp yarns are interwoven to form a Weft B weave. Two combination methods for color expression are used in a single-warp and double-weft structure with the arrangement ratio of Weft A and Weft B of 2:1 (B and C in FIG. 1). When a face weft is the Weft A, the Weft A weave is a face weave and the Weft B weave is a backing weave. When the face weft is the Weft B, the Weft B weave is a face weave and the Weft A weave is a backing weave. A Weft B weave with a number of weave repeats of 16×8 is selected, and then a number of weave repeats of the Weft A weave is 16×16.

2. In FIG. 2 to FIG. 8, when the face weft is the Weft B, 16-satin with a step number of 10 with a starting point position at a lower left corner (warp, weft)=(1, 1) are selected as a backing weave $A_L$. The backing weave $A_L$ is reversed to obtain a reverse weave $A_LF$, and the reverse weave is 16-sateen with a step number of 5 with a starting point position of (1,1). Then the $A_LF$ is decomposed into decomposed weaves $A_LF1$ and $A_LF2$ according to odd and even wefts, and step numbers of the $A_LF1$ and $A_LF2$ are both 10. Finally, warp weave points of the $A_LF1$ are superimposed on the $A_LF2$ to obtain backed points Bj. Bj is a strengthened sateen with a number of weave repeats of 16×8, a starting point position of (1,1) and a step number of 10. One weave point is selected for each weft from all weft weave points of the Bj as warp weave points to form a face weave $B_B$ on the premise of meeting balanced interlacement. As a preferable solution, a step number of the face weave $B_B$ is selected the same as that of the $A_LF1$ or $A_LF2$. Starting from a starting point position at a lower left corner (warp, weft)=(1, 1), a weft-faced weave is designed according to a step number of 10 in a weave grid with a number of weave repeats of 16×8. Then, each time when the starting point is moved one weave point in a weft direction, one new weave is designed, and a series of weaves are designed until the starting point position is (16, 1). The weaves having warp weave points overlapping with that of the Bj are eliminated from this series of weaves, that is, the $A_LF1$ and $A_LF2$ with the starting point positions being (1,1) and (6,1) respectively are eliminated to obtain all alternative weaves of the face weave $B_B$ that meet requirements. There are $(2R-J_1)=16-2=14$ alternative weaves in total. According to the requirements, a sateen with a number of weave repeats of 16×8, a step number of 10, and the starting point position at a lower left corner (warp, weft)=(9, 1) is selected as the face weave $B_B$.

Figure 16:
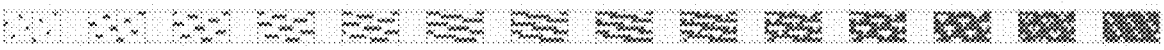
FIG. 16 shows a shaded weave-database of the face weave $B_B$ when the face weft is the Weft B.

3. In FIG. 9 to FIG. 14, when the face weft is the Weft A, in order to improve the design efficiency, the reverse weave of the above face weave $B_B$ is selected as a backing weave $B_L$, a satin with a starting point position at a lower left corner (warp, weft)=(9, 1), a number of weave repeats of 16×8, and a step number of 10 is selected as the backing weave $B_L$. One warp weave point is selected for each weft from all warp weave points of the $B_L$ to form an odd-weft decomposed weave $A_B1$ or an even-weft decomposed weave $A_B2$ of a face weave $A_B$ on the premise of meeting balanced interlacement. As a preferable solution, the backing weave $B_L$ is reversed to obtain a reverse weave $B_LF$. A step number of the decomposed weaves $A_B1$ and $A_B2$ is selected the same as that of the $B_LF$. Starting from a starting point position at a lower left corner (warp, weft)=(1, 1), a weft-faced weave is designed according to a step number of 10 in a weave grid with a number of weave repeats of 16×8. Then, each time when the starting point is moved one weave point in the weft direction, one new weave is designed, and a series of weaves are designed until the starting point position is (16, 1). The weaves having warp weave points overlapping with that of the $B_LF$ are eliminated from this series of weaves, that is, the $B_LF$ with the starting point position of (9,1) is eliminated to obtain all alternative decomposed weaves of the face weave $A_B$ that meet requirements. There are $(2R-J_2)=(2\times8-1)=15$ alternative weaves in total. According to the requirements, weaves with starting point positions at a lower left corner (warp, weft)=(1, 1) and (5,1) are selected from the alternative decomposed weaves and taken as the $A_B1$ and $A_B2$, and the $A_B1$ and $A_B2$ are arranged and combined in 1:1 in a warp direction to obtain 16-sateen with a step number of 5 with a starting point position at a lower left corner (warp, weft)=(1, 1) as the face weave $A_B$. There are $[2(R-J_2J)(R-J_2O)]=2X(8-1)X(8-0)=112$ face weaves designed by such method in total. In FIG. 16, each weft of the $B_LF$ is extended one weft upwards in the warp direction or two $B_LF$ are arranged and combined in 1:1 in the warp direction to obtain backed points Aj. Aj is a strengthened weft-faced 16-twill with a starting point position of (9,1) and a step number of 10.

Figure 17:
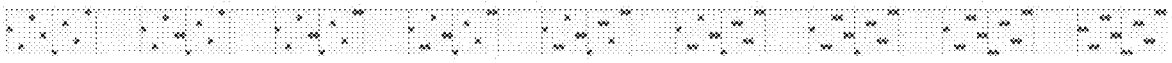
FIG. 17 is a schematic diagram of increasing a maximum number of weaves between a first weave and a second weave in the shaded weave-database when the face weft is the Weft B (an added value of weave points is 1)

4. In FIG. 16, when designing a shaded weave-database of the face weave $B_B$, the face weave $B_B$ is taken as a primary weave, and various values between 1 and 8 can be selected for the weave point strengthening. For the convenience of presentation, this example uses N=R=8 point strengthening and weft-direction reinforcement. During strengthening, the weave points shall be continuous as far as possible. When encountering the backed points Bj, it skips without adding points. The shaded weave-database of $(2R-J_1)=2\times8-2=14$ shaded effects is formed. FIG. 17 shows the use of N=1 strengthening method (between the first and second weaves, and the rest is the same), a maximum number of shaded weaves available is $[R(2R-1-J_1)+1]=8\times(2\times8-1-2)+1=105$.

Figure 18:
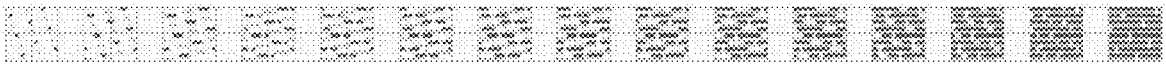
FIG. 18 shows a shaded weave-database of the face weave $A_B$ when the face weft is the Weft A.
Figure 19:
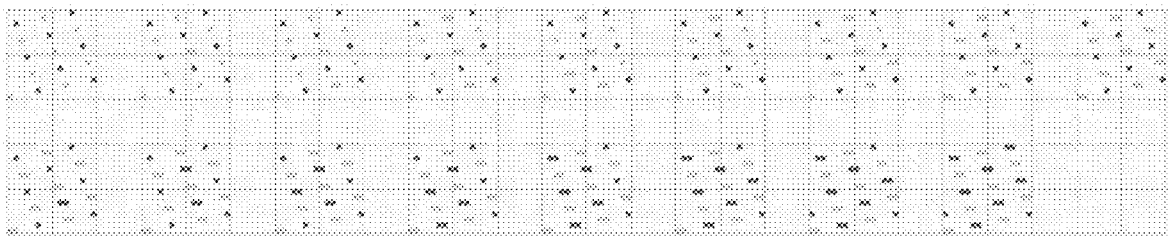
FIG. 19 is a schematic diagram of increasing a maximum number of weaves between a first weave and a second weave in the shaded weave-database when the face weft is the Weft A (an added value of weave points is 1)

5. In FIG. 18, when designing a shaded weave-database of the face weave $A_B$, the face weave $A_B$ is taken as a primary weave, and various values between 1 and 16 can be selected for the weave point strengthening. For the convenience of presentation, this example uses N=2R=16 point strengthening and weft-direction reinforcement. During strengthening, the weave points shall be continuous as far as possible. When encountering the backed points Aj, it skips without adding points. The shaded weave-database of $(2R-J_2)=2\times8-1=15$ shaded effects is formed. FIG. 19 shows the use of N=1 strengthening method (between the first and second weaves, and the rest is the same), a maximum number of shaded weaves available is $[2R(2R-1-J_2)+1]=2\times8\times(2\times8-1-1)+1=225$.

Figure 20:
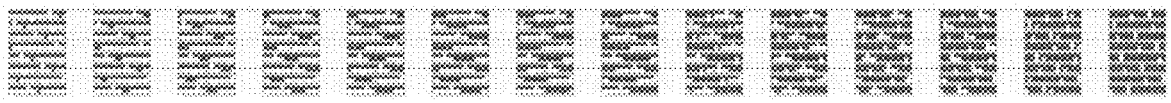
FIG. 20 is a schematic structural diagram of the face weave $B_B$ and the backing weave $A_L$ combined in an order of ABA and a ratio of 2:1 from bottom to top in a warp direction when the face weft is the Weft B.

5. In FIG. 20, the Weft A and the Weft B are arranged in an order of ABA and a ratio of 2:1 from bottom to top in the warp direction. The backing weave $A_L$ is drawn at interweaving positions of the Weft A and the warp yarns. The face weave $B_B$ is drawn at interweaving positions of the Weft B and the warp yarns. After combination, a number of weave repeats is 16×24, and a compound structure diagram with the Weft B covering the Weft A is obtained. According to this method, each weave in the shaded weave-database of the face weave $B_B$ is combined with the backing weave $A_L$ to obtain a database of the compound structure with the Weft B covering the Weft A.

Figure 21:
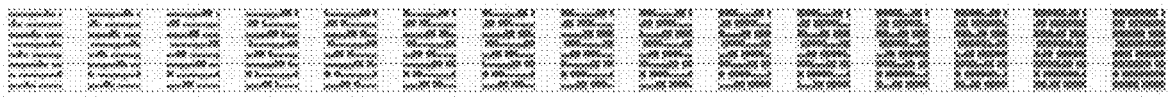
FIG. 21 is a schematic structural diagram of the face weave $A_B$ and the backing weave $B_L$ combined in an order of ABA and a ratio of 2:1 from bottom to top in a warp direction when the face weft is the Weft A.

6. In FIG. 21, the Weft A and the Weft B are arranged in an order of ABA and a ratio of 2:1 from bottom to top in the warp direction. The face weave $A_B$ is drawn at interweaving positions of the Weft A and the warp yarns. The backing weave $B_L$ is drawn at interweaving positions of the Weft B and the warp yarns. After combination, a number of weave repeats is 16×24, and a compound structure diagram with the Weft A covering the Weft B is obtained. According to this method, each weave in the shaded weave-database of the face weave $A_B$ is combined with the backing weave $B_L$ to obtain a database of the compound structure with the Weft A covering the Weft B.

Figure 2:
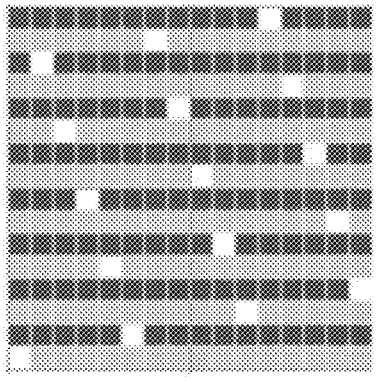
FIG. 2 shows a backing weave $A_L$ when a face weft is the Weft B.
Figure 3:
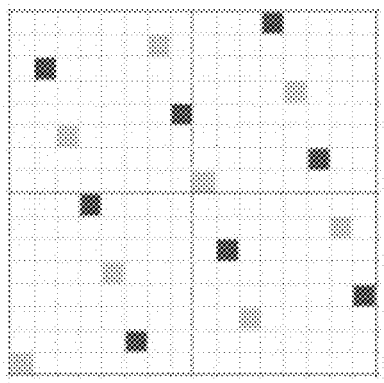
FIG. 3 shows a reverse weave $A_LF$ of the backing weave $A_L$ when the face weft is the Weft B.
Figure 4:
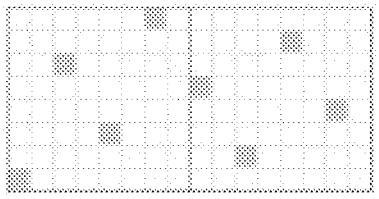
FIG. 4 shows an odd-weft decomposed weave $A_LF1$ of the $A_LF$ when the face weft is the Weft B.
Figure 5:
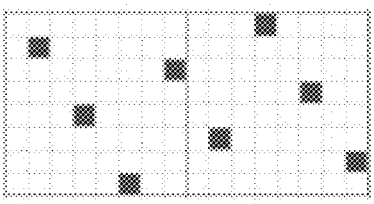
FIG. 5 shows an even-weft decomposed weave $A_LF2$ of the $A_LF$ when the face weft is the Weft B.
Figure 6:
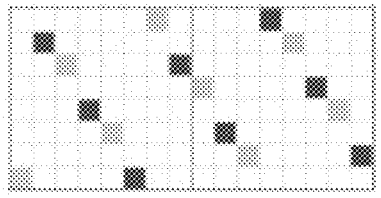
FIG. 6 shows backed points Bj when the face weft is the Weft B.
Figure 7:
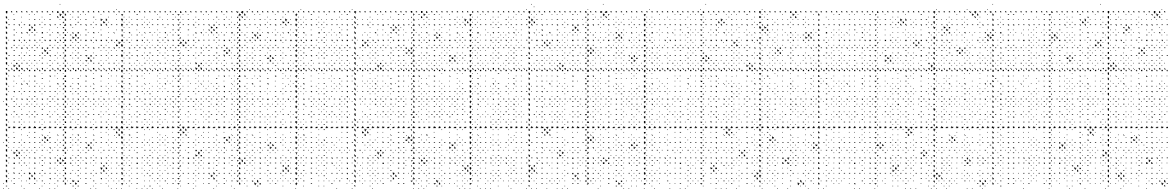
FIG. 7 shows a series of alternative weaves of a face weave $B_B$ when the face weft is the Weft B.
Figure 8:
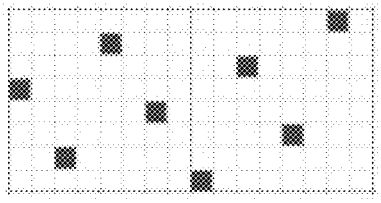
FIG. 8 shows the face weave $B_B$ when the face weft is the Weft B.

7. In FIG. 2 and FIG. 16, the most warp-faced and weft-faced weaves in the shaded weave-database of the face weave $B_B$ are combined with the backing weave $A_L$ for verification. If both compound structures are capable of meeting requirements that any one weft of the backing weave is capable of being covered by the adjacent face weaves, it indicates that combination of any one weave in the shaded weave-database with the backing weave is capable of meeting technical requirements of covering.

Figure 9:
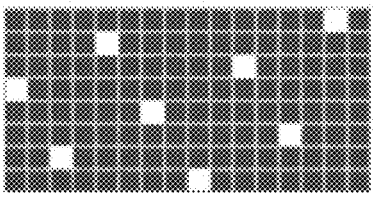
FIG. 9 shows a backing weave $B_L$ when the face weft is the Weft A.
Figure 10:
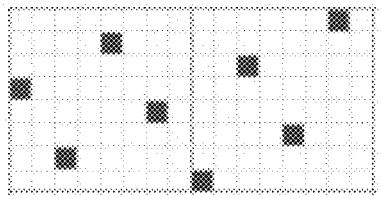
FIG. 10 shows a reverse weave $B_LF$ of the backing weave $B_L$ when the face weft is the Weft A.
Figure 11:
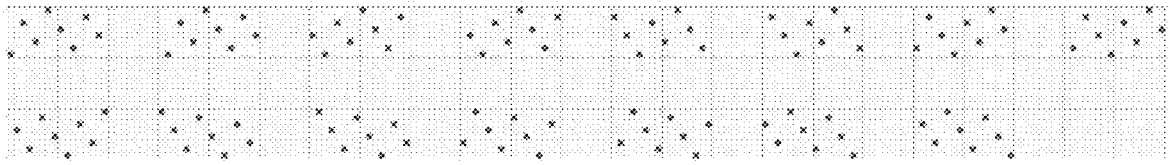
FIG. 11 shows alternative decomposed weaves of a face weave $A_B$ when the face weft is the Weft A.
Figure 12:
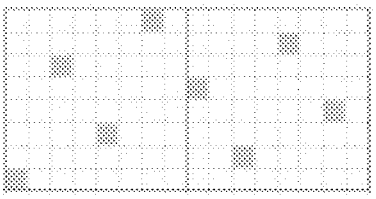
FIG. 12 shows an odd-weft decomposed weave $A_B1$ of the face weave $A_B$ when the face weft is the Weft A.
Figure 13:
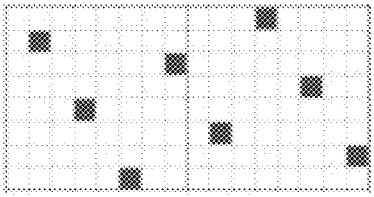
FIG. 13 shows an even-weft decomposed weave $A_B2$ of the face weave $A_B$ when the face weft is the Weft A.
Figure 14:
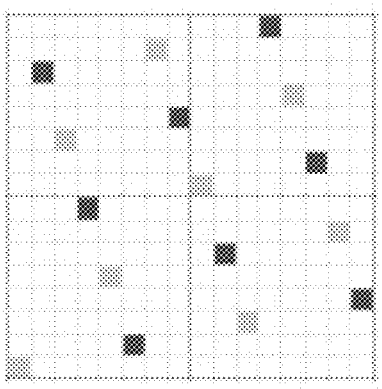
FIG. 14 shows the face weave $A_B$ when the face weft is the Weft A.
Figure 15:
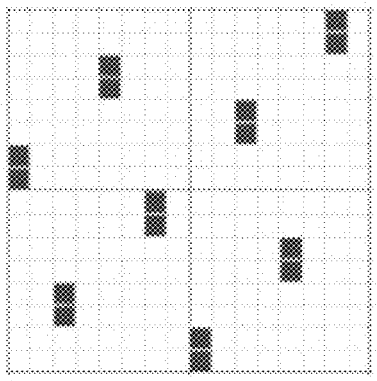
FIG. 15 shows backed points Aj of the face weave $A_B$ when the face weft is the Weft A.

8. In FIG. 9 and FIG. 18, the most warp-faced and weft-faced weaves in the shaded weave-database of the face weave $A_B$ are combined with the backing weave $B_L$ for verification. If both compound structures are capable of meeting requirements that when the face weave expresses a color on the surface of the fabric, the backing weave has no effect on the color expression of the face weave, it indicates that combination of any one weave in the shaded weave-database with the backing weave is capable of meeting technical requirements of full covering.

9. A bitmap mode is used for the designed digital pattern. The subject matter is not limited. The pattern size, width and height are set to 2400 pixels. The pattern is in two colors. Each color is designed with shaded color, and a grade number of the shaded color is less than or equal to a maximum number of shaded weaves. The digital pattern with two color shading effects is formed. A maximum number of colors in the digital pattern is $[R/N(6R-2J_2-J_1-3)+2]=8\times(6\times 8-2\times1-2-3)+2=330$.

Figure 22:
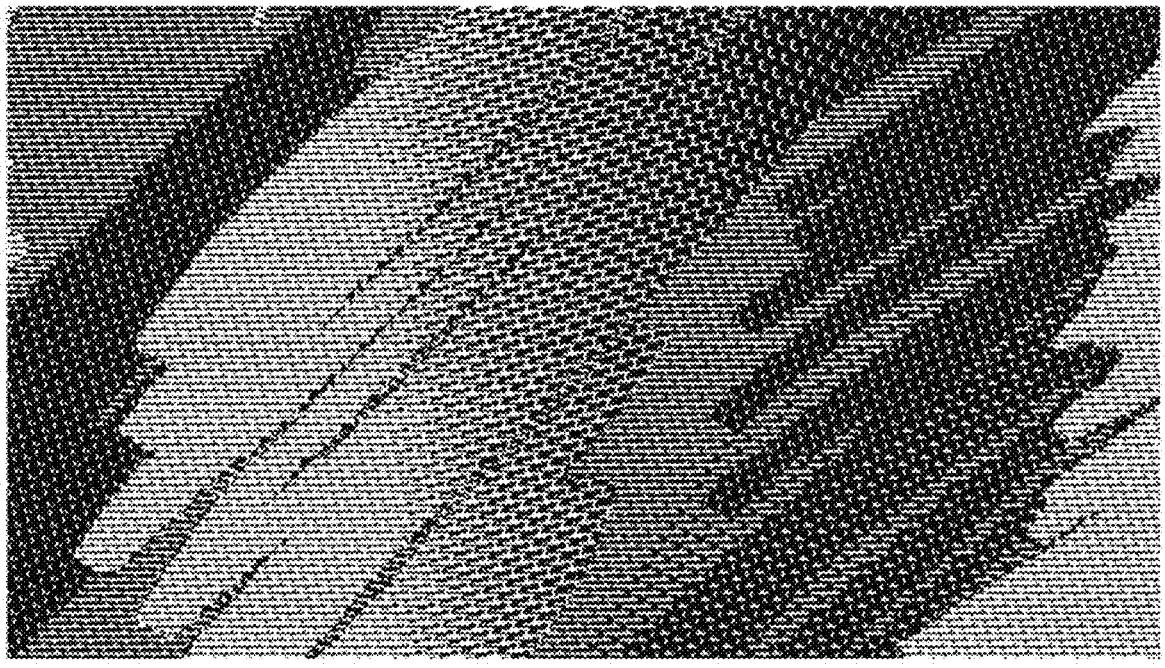
FIG. 22 is a partial effect view of the weft-backed jacquard fabric with the color shading effect formed in the present disclosure.

10. A shaded color in the two shaded colors of the digital pattern needing to reflect a pure color shading effect of the fabric is matched with the database of the compound structure with the Weft A covering the Weft B. The shaded color needing to reflect a mixed color shading effect is matched with the database of the compound structure with the Weft B covering the Weft A. Processing is performed by a computer, and then the shaded color of each gray level is replaced with the weaves in the corresponding weave-database by a one-to-one correspondence method to form a compound structure diagram of the weft-backed jacquard fabric with the color shading effect with the arrangement ratio of the Weft A and the Weft B of 2:1. A partial effect view of the fabric is shown in FIG. 22.

Figure 23:
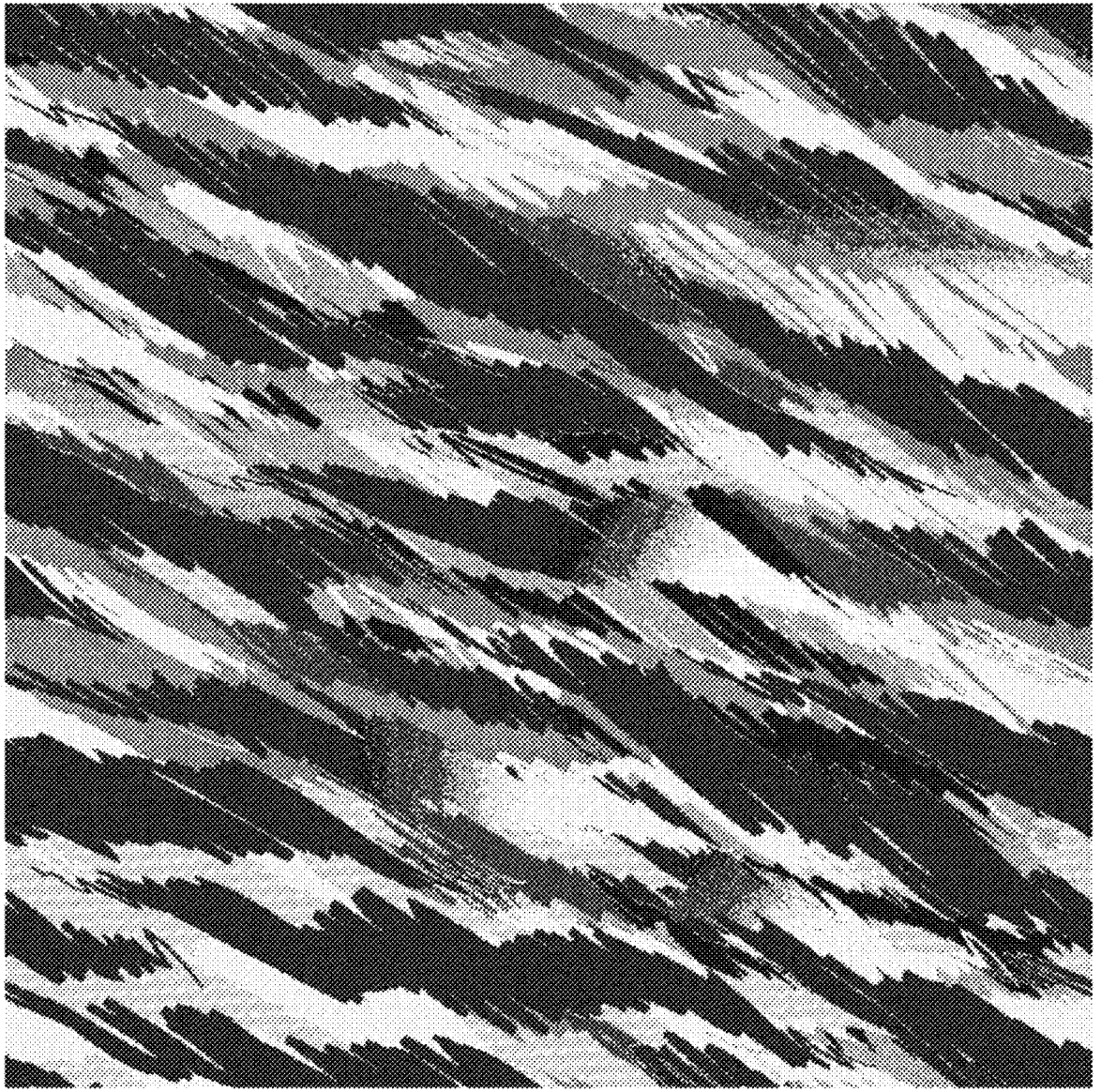
FIG. 23 is a physical effect view of the weft-backed jacquard fabric with the color shading effect formed in the present disclosure.

11. Weft picking information is set as Weft A:Weft B=2:1 on the compound structure diagram of the 2:1 weft-backed jacquard fabric with the color shading effect. A warp and weft density is set as 114×84. One group of white warp yarns is selected as warp threads, one group of black weft yarns is selected as the Weft A, and one group of red weft yarns is selected as the Weft B. Then the 2:1 weft-backed jacquard fabric with the color shading effect can be produced. The surface of the fabric has two color shading effects of color shading of the Wefts A and mixed color shading of the Wefts A and the Wefts B. An effect view of the fabric is shown in FIG. 23.

12. The embodiments prove that as long as the backed points in the face weave are not destroyed, the fabric structure designed by the implementation method of the technical invention meets balanced interlacement and the covering requirements, is suitable for computer images of any subject matter, and can meet the technical requirements of mass production.

What is claimed is:

1. A weaving method of a weft-backed jacquard fabric with color shading effects, wherein the fabric is formed by interweaving 2 sets of weft yarns and 1 set of warp yarns, a Weft A and a Weft B have an arrangement ratio of 2:1, and the fabric is processed in the weaving method comprising the steps of:

(1) constructing a structural model by, weaving the fabric by 1 set of the warp yarns and 2 sets of the weft yarns, wherein the warp yarns are in one color, the weft yarns are in two colors for the Weft A and the Weft B, the Weft A and the Weft B have the arrangement ratio of 2:1, the Weft A and the warp yarns are interwoven to form a Weft A weave, and the Weft B and the warp yarns are interwoven to form a Weft B weave, (2) selecting the Weft A weave and Weft B weave by, selecting the Weft A weave in a range of twill or satin, wherein a number of weave repeats is 2R×2R in a range between 4×4 and 48×48, selecting the Weft B weave in a range of derivative weaves of warp-separated plain, twill and satin, wherein a number of weave repeats is 2R×R in a range between 4×2 and 48×24, and where $2\leq R\leq 24$ and R is a positive integer;

(3) designing face weave and backing weave and backed points by, when a face weft is the Weft B, selecting a warp-faced weave as a backing weave $A_L$ in the selection range of the Weft A weave; backed points Bj is set by reversing the $A_L$ and decomposing an obtained weave into weaves $A_LF1$ and $A_LF2$ according to odd and even wefts, then superimposing warp weave points of the $A_LF2$ on the $A_LF1$; and selecting one weave point for each weft from all weft weave points of the Bj as warp weave points to form a face weave $B_B$ based on meeting balanced interlacement, and when the face weft is the Weft A, selecting a warp-faced weave as a backing weave $B_L$ in the selection range of the Weft B weave; selecting one warp weave point for each weft from all warp weave points of the $B_L$ based on meeting balanced interlacement to form a decomposed weave $A_B1$ or $A_B2$ of a face weave $A_B$, and then arranging and combining the $A_B1$ and $A_B2$ in 1:1 in a warp direction to obtain the face weave $A_B$; and reversing the $B_L$ to obtain a reverse weave $B_LF$, and then extending each weft of the reverse weave $B_LF$ one weft upwards in the warp direction or arranging and combining two $B_LF$ in 1:1 in the warp direction to set backed points Aj, (4) designing a shaded weave-database by designing the shaded weave-database of the face weave $B_B$ or $A_B$ by strengthening the weave points by means of warp-direction, weft-direction or oblique-direction transition without destroying the backed points Bj or Aj, (5) designing a compound structure by, determining that the weft yarns of the Weft A and the Weft B have the arrangement ratio of 2:1, drawing the backing weave $A_L$ at interweaving positions of the Weft A and the warp yarns, and drawing the face weave $B_B$ at interweaving positions of the Weft B and the warp yarns to obtain a database of the compound structure with the Weft B covering the Weft A, and determining that the weft yarns of the Weft A and the Weft B have the arrangement ratio of 2:1, drawing the face weave $A_B$ at the interweaving positions of the Weft A and the warp yarns, and drawing the backing weave $B_L$ at the interweaving positions of the Weft B and the warp yarns to obtain a database of the compound structure with the Weft A covering the Weft B, (6) verifying the backed points by, combining the most weft-faced and warp-faced weaves in the shaded weave-database with the backing weave respectively, wherein if both weaves are capable of meeting requirements that any one weft of the backing weave is capable of being covered by adjacent face weaves, combination of any one weave in the shaded weave-database with the backing weave is capable of meeting technical requirements of covering, (7) designing a digital pattern by designing a digital pattern with two color shading effects according to requirements, wherein the pattern is in two colors, and each color is designed with shaded color, and a grade number of the shaded color is less than or equal to a maximum number of shaded weaves, (8) designing a compound structure of the fabric by matching a shaded color in the two shaded colors of the digital pattern needing to reflect a pure color shading effect of the fabric with the database of the compound structure with the Weft A covering the Weft B, matching the shaded color needing to reflect a mixed color shading effect with the database of the compound structure with the Weft B covering the Weft A, processing by a computer, and replacing the shaded color of each grade with the weaves in the corresponding weave-database by a one-to-one correspondence method to form a compound structure diagram of the weft-backed jacquard fabric with color shading effects, and (9) weaving by, setting weft picking information on the obtained compound structure of the fabric, setting a warp and weft density, selecting one group of warp threads and two groups of colored weft threads, and then putting the warp threads and the weft threads into weaving.

2. The weaving method of a weft-backed jacquard fabric with color shading effects according to claim 1, wherein in step (3), when the face weft is the Weft B, a weave having the same number of weave repeats as the $A_LF1$ or $A_LF2$ and warp weave points not overlapping with that of the Bj is selected as the face weave $B_B$, and a starting point displacement method is used to obtain $(2R-J_1)$ alternative face weaves having the same step number as the $A_LF1$ or $A_LF2$.

3. The weaving method of a weft-backed jacquard fabric with color shading effects according to claim 1, wherein in step (3), when the face weft is the Weft A, a weave having the same number of weave repeats as the $B_LF$, the reverse weave of $B_L$, and warp weave points not overlapping with that of the $B_LF$ is selected as the decomposed weave of the face weave $A_B$, and a starting point displacement method is used to obtain $(2R-J_2)$ alternative decomposed weaves having the same step number as the $B_LF$.

4. The weaving method of a weft-backed jacquard fabric with color shading effects according to claim 3, wherein in step (3), when the face weft is the Weft A, weaves with odd and even warps at starting point positions are selected from the alternative decomposed weaves and taken as the $A_B1$ and $A_B2$ respectively, then the $A_B1$ and $A_B2$ are arranged and combined in 1:1 in the warp direction to obtain the face weave $A_B$, there are $[2(R-J_2J)(R-J_2O)]$ such weaves in total, and $J_2J$ and $J_2O$ are respectively numbers of backed points at odd and even warps on one weft yarn when the Weft A is used as the face weft.

5. The weaving method of a weft-backed jacquard fabric with color shading effects according to claim 1, wherein in step (3), for the face weave $B_B$ and the backing weave $A_L$ when the Weft B is selected as the face weft, when the Weft A is designed as the face weft, the face weave $B_B$ and the backing weave $A_L$ are reversed as the backing weave $B_L$ and the face weave $A_B$; and alternatively, for the face weave $A_B$ and the backing weave $B_L$ when the Weft A is selected as the face weft, when the Weft B is designed as the face weft, the face weave $A_B$ and the backing weave $B_L$ are reversed as the backing weave $A_L$ and the face weave $B_B$.

6. The weaving method of a weft-backed jacquard fabric with color shading effects according to claim 1, wherein in step (2), a number of warp repeats of the Weft A weave is the same as that of the Weft B weave, and a number of weft repeats of the Weft A weave is twice that of the Weft B weave.

7. The weaving method of a weft-backed jacquard fabric with color shading effects according to claim 1, wherein in step (7), the maximum number of the shaded weaves is $[R/N(6R-2J_2-J_1-3)+2]$, R is a number of weft repeats of the Weft B, N is an added value of weave points, and $J_1$ and $J_2$ are respectively numbers of backed points on one weft yarn in one weave repeat when the Weft B and the Weft A are used as the face weft.

8. The weaving method of a weft-backed jacquard fabric with color shading effects according to claim 1, wherein in one weave repeat, a weft float length or weft float number of the face weft is greater than that of the backing weft.

* * * * *